US007853170B2

(12) United States Patent
Ueda et al.

(10) Patent No.: US 7,853,170 B2
(45) Date of Patent: Dec. 14, 2010

(54) IMAGE FORMING APPARATUS HAVING A CLEANING MEMBER THAT CLEANS A TRANSMITTING MEMBER PROVIDED IN AN OPTICAL DEVICE

(75) Inventors: Shinichi Ueda, Mishima (JP); Shuji Nishitani, Suntou-gun (JP); Naonori Kayama, Yokohama (JP); Masaki Sato, Numazu (JP); Hiroshi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 12/414,391

(22) Filed: Mar. 30, 2009

(65) Prior Publication Data

US 2009/0245866 A1 Oct. 1, 2009

(30) Foreign Application Priority Data

Mar. 31, 2008 (JP) ..... 2008-090199
Mar. 31, 2008 (JP) ..... 2008-090202
Mar. 31, 2008 (JP) ..... 2008-090203

(51) Int. Cl.
*G03G 21/00* (2006.01)
*G03G 15/20* (2006.01)

(52) U.S. Cl. ..... 399/98; 399/123

(58) Field of Classification Search ..... 399/98, 399/99, 107, 118, 123
See application file for complete search history.

(56) References Cited

U.S. PATENT DOCUMENTS 5,089,850 A * 2/1992 Ogura et al. ..... 399/99
5,689,769 A * 11/1997 Appel et al. ..... 399/98
6,463,236 B2 * 10/2002 Morikami et al. ..... 399/98 X
7,203,444 B2 * 4/2007 Yamazaki ..... 399/98
7,436,426 B2 * 10/2008 Lim ..... 399/99 X
7,515,171 B2 * 4/2009 Lim ..... 399/98 X
2006/0001980 A1 1/2006 Namba

FOREIGN PATENT DOCUMENTS

JP 2-64682 A 3/1990
JP 5-281625 A 10/1993
JP 9-160465 A 6/1997
JP 11-295950 A 10/1999
JP 2001-343876 A 12/2001
JP 2004-85899 A 3/2004
JP 2005-246901 A 9/2005
JP 2006-44229 A 2/2006
JP 2006-276226 A 10/2006

* cited by examiner

*Primary Examiner*—Sandra L Brase
(74) *Attorney, Agent, or Firm*—Canon USA Inc IP Division

(57) ABSTRACT

An image forming apparatus including a cartridge that has a photosensitive drum and can be attached to and detached from a main body of the image forming apparatus, an optical device that has a cover glass through which light emitted toward the photosensitive drum passes, a cleaning member that can move from a cleaning start position to a cleaning end position for cleaning the cover glass, and a lock member that prevents the cleaning member from moving. Before the cartridge is attached, the lock member prevents the cleaning member from moving in the longitudinal direction of the cover glass. During the attachment of the cartridge, the cartridge engages with the lock member and unlocks the cleaning member and enables the cleaning member to move from the cleaning start position.

8 Claims, 11 Drawing Sheets

IMAGE FORMING APPARATUS HAVING A CLEANING MEMBER THAT CLEANS A TRANSMITTING MEMBER PROVIDED IN AN OPTICAL DEVICE

BACKGROUND OF THE INVENTION

1. Field of the Invention

The present invention relates to an image forming apparatus such as a copying machine, a printer, or a facsimile, and more specifically, the image forming apparatus includes a cleaning member that cleans a transmitting member provided in an optical device.

2. Description of the Related Art

Electrophotographic image forming apparatuses use toner as developer. Toner particles along with dust may build-up within the image forming apparatus. An optical device provided in an image forming apparatus may be adversely affected if exposed to toner, dust, and so forth. To prevent toner and dust from entering the inside of the optical device, the inside of the optical device is sealed. The image forming apparatus has an opening through which laser emitted from the optical device passes. To prevent toner and dust from entering the inside of the optical device, the opening has a cover glass through which laser can pass.

If toner that falls from a developing section and floats onto the image forming apparatus and dust that floats onto the image forming apparatus adhere to the cover glass and block the light path of exposure, reduction in density of a printed image or lack of image occurs. To prevent toner and dust from adhering to the cover glass, a user or serviceman accesses the inside of the main body of the image forming apparatus and cleans the cover glass with a soft cloth. However, the opening having the cover glass is small in area and the user or serviceman needs to clean the surface of the cover glass without damaging the cover glass.

Japanese Patent Laid-Open No. 2005-246901 proposes a cleaning configuration capable of removing toner, dust, and so forth attached to a cover glass. Specifically, a user or serviceman slides a cleaning member provided in an optical scanning device along a cover glass, and thereby toner, dust, and so forth attached to the cover glass can be removed.

In the configuration of Japanese Patent Laid-Open No. 2005-246901, the user or serviceman slides the cleaning member and thereby cleans the cover glass. So, the user or serviceman needs to perform an operation for moving the cleaning member.

SUMMARY OF THE INVENTION

The present invention provides an image forming apparatus in which before the attachment of a cartridge, before the start of cleaning, a cleaning member can be held at a fixed position, and during the attachment of the cartridge, during cleaning, the cleaning member can operate reliably. The cleaning member cleans a cover glass in conjunction with the attachment of the cartridge.

In an aspect of the present invention, an image forming apparatus includes a unit, an optical device, a cleaning member, and a lock member. The unit can be attached to and detached from a main body of the apparatus. The optical device irradiates a photosensitive member with light. The device includes a transmitting member through which light passes. The cleaning member can move from a cleaning start position to a cleaning end position for cleaning the transmitting member. The cleaning member is capable of moving in conjunction with the attachment of the unit into the main body. The lock member prevents the cleaning member from moving. When the unit is not loaded in the main body, the lock member prevents the cleaning member from moving from the cleaning start position. When the unit is attached to the main body, the unit engages the lock member and the lock member unlocks the cleaning member and enables the cleaning member to move from the cleaning start position.

Further features of the present invention will become apparent from the following description of exemplary embodiments with reference to the attached drawings.

DESCRIPTION OF THE EMBODIMENTS

The embodiments of the present invention will hereinafter be described in detail with reference to the drawings. It should be noted that the sizes, materials, shapes, relative arrangement, and so forth of components described in the embodiments are not intended to limit the scope of the present invention unless otherwise specified.

Image Forming Apparatus

Figure 1:
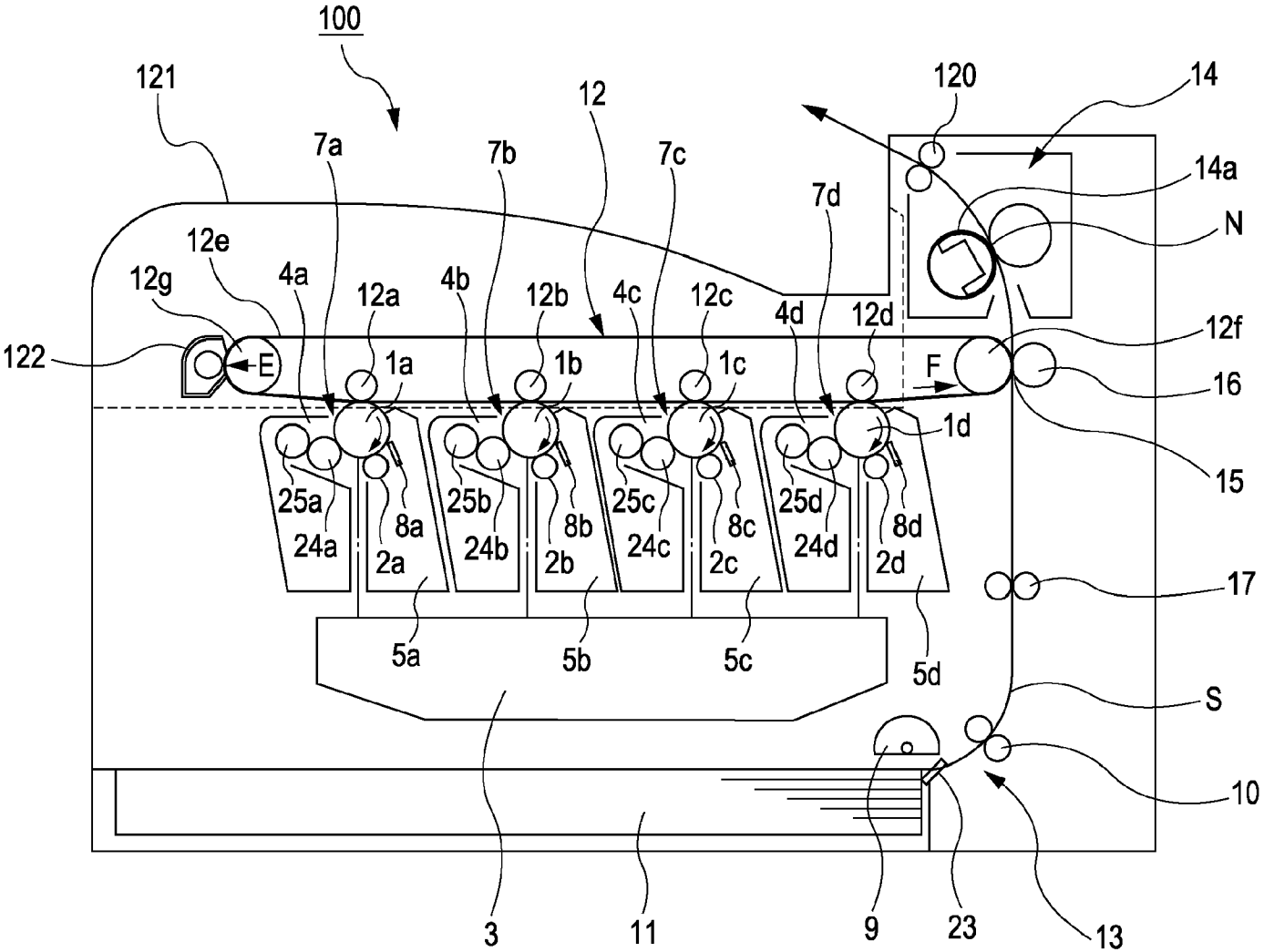
FIG. 1 is a configuration view of an image forming apparatus according to a first embodiment.

The overall configuration of an image forming apparatus will be outlined. FIG. 1 is a configuration view of an image forming apparatus according to a first embodiment.

As shown in FIG. 1, a color laser printer 100 that is an example of an image forming apparatus has four process cartridges 7 (7*a*, 7*b*, 7*c*, and 7*d*) loaded therein, which constitute first to fourth image forming sections, respectively. The first to fourth image forming sections form yellow, magenta, cyan, and black images, respectively, and have the same configuration except for the color of toner. The reference letters a, b, c, and d shown in FIG. 1 denote members corresponding to the yellow, magenta, cyan, and black image forming sections, respectively. In the following description, when the members need not be distinguished by color, the reference letters a, b, c, and d will be omitted.

Each process cartridge 7 includes a developing unit 4 and a cleaner unit 5 integrated with each other.

The developing unit 4 includes a developing roller 24, a developer applying roller 25, and a toner container.

The cleaner unit 5 includes a photosensitive drum 1 that is a photosensitive member rotatable in the direction of the arrow (clockwise direction) in FIG. 1, a charging roller 2 that is a charging unit, a cleaning blade 8 that is a cleaning unit, and a waste toner container. Each process cartridge 7 is a detachable unit that is attached to and detached from a main body of the color laser printer 100 in the direction of the axis of rotation of the photosensitive drum 1. In other words, the unit is inserted into and pulled out of the main body.

Around each photosensitive drum 1, in the direction of rotation thereof, are arranged a charging roller 2, a light path of laser light emitted from an optical device 3, a developing unit 4, a transfer surface of an intermediate transfer belt unit 12, and a cleaning blade 8 in this order.

By bringing the charging roller 2 into contact with the surface of the photosensitive drum 1 and applying a charge bias voltage by a power source (not shown), the surface of the photosensitive drum 1 is uniformly charged.

The optical device 3 is disposed under the process cartridges 7, and it exposes the photosensitive drum 1 to an image signal and forms an electrostatic latent image on the photosensitive drum 1.

The photosensitive drums 1 are charged by the charging rollers 2 to a predetermined negative potential, and then electrostatic latent images are formed on the respective photosensitive drums 1 by the optical device 3. The electrostatic latent images are reverse-developed by the developing units 4 and toner with negative polarity is attached thereto. Thus, yellow, magenta, cyan, and black toner images are formed.

In the intermediate transfer belt unit 12, an intermediate transfer belt 12*e* is looped over a driving roller 12*f* and a tension roller 12*g*, the tension roller 12*g* tensioning the intermediate transfer belt 12*e* in the direction of arrow E. Opposite the respective photosensitive drums 1 and inside the intermediate transfer belt 12*e* are arranged primary transfer rollers 12*a*, 12*b*, 12*c*, and 12*d*, to which a transfer bias is applied by a bias applying unit (not shown).

Each photosensitive drum rotates in the direction of the arrow, the intermediate transfer belt 12*e* rotates in the direction of arrow F, and a positive bias is applied to the primary transfer rollers 12*a* to 12*d*. Thereby, the toner images are primarily-transferred onto the intermediate transfer belt 12*e* in order from the toner image on the photosensitive drum 1*a*. Thus, four colors of toner images are conveyed in a superimposed state to a secondary transfer section 15.

A feeding device 13 includes a feeding roller 9 and a conveying roller pair 10. The feeding roller 9 feeds a sheet S out of a feeding cassette 11 that contains sheets S. The conveying roller pair 10 conveys the fed sheet S. The feeding cassette 11 is configured to be able to be pulled out perpendicularly to plane of FIG. 1 (from the front of the apparatus). The user pulls the feeding cassette 11 out of the main body of the apparatus, then loads sheets S in the feeding cassette 11, and attaches the feeding cassette 11 into the main body to complete the replenishment of sheets.

The sheets S contained in the feeding cassette 11 are pressed against the feeding roller 9 and separated one at a time by a separating pad 23 (friction piece separating method) and conveyed.

The sheet S conveyed from the feeding device 13 is conveyed by a registration roller pair 17 to a secondary transfer section 15.

In the secondary transfer section 15, by applying a positive bias to a secondary transfer roller 16, the four colors of toner images on the intermediate transfer belt 12*e* are secondarily-transferred onto the conveyed sheet S. A fixing section 14 that is a fixing unit applies heat and pressure to the image formed on the sheet S, thereby fixing the image.

In the process in which the sheet S is conveyed together with a fixing belt 14*a* through a fixing nip section N, the sheet S is heated by a heater in the fixing belt 14*a*, and the unfixed toner image on the sheet S is heated and fixed. The sheet S to which the image is fixed is ejected by an ejecting roller pair 120 onto an output tray 121.

After the toner image transfer, toner remaining on the surfaces of the photosensitive drums 1 is removed by the cleaning blades 8. The removed toner is recovered into the waste toner containers in the cleaner units 5.

Toner remaining on the intermediate transfer belt 12*e* after the secondary transfer to the sheet S is removed by a transfer belt cleaning device 122. The removed toner is recovered through a waste toner conveying path (not shown) into a waste toner recovery container (not shown) disposed in the rear of the apparatus. In the color laser printer 100, replenishment of sheets to the feeding cassette 11, attachment and detachment of the process cartridges 7, and recovery of printed sheets can be performed from the front of the apparatus. Each process cartridge 7 can be attached to and detached from the main body in the direction of the axis of rotation of its respective photosensitive drum 1.

Cleaning Member 20

Figure 2:
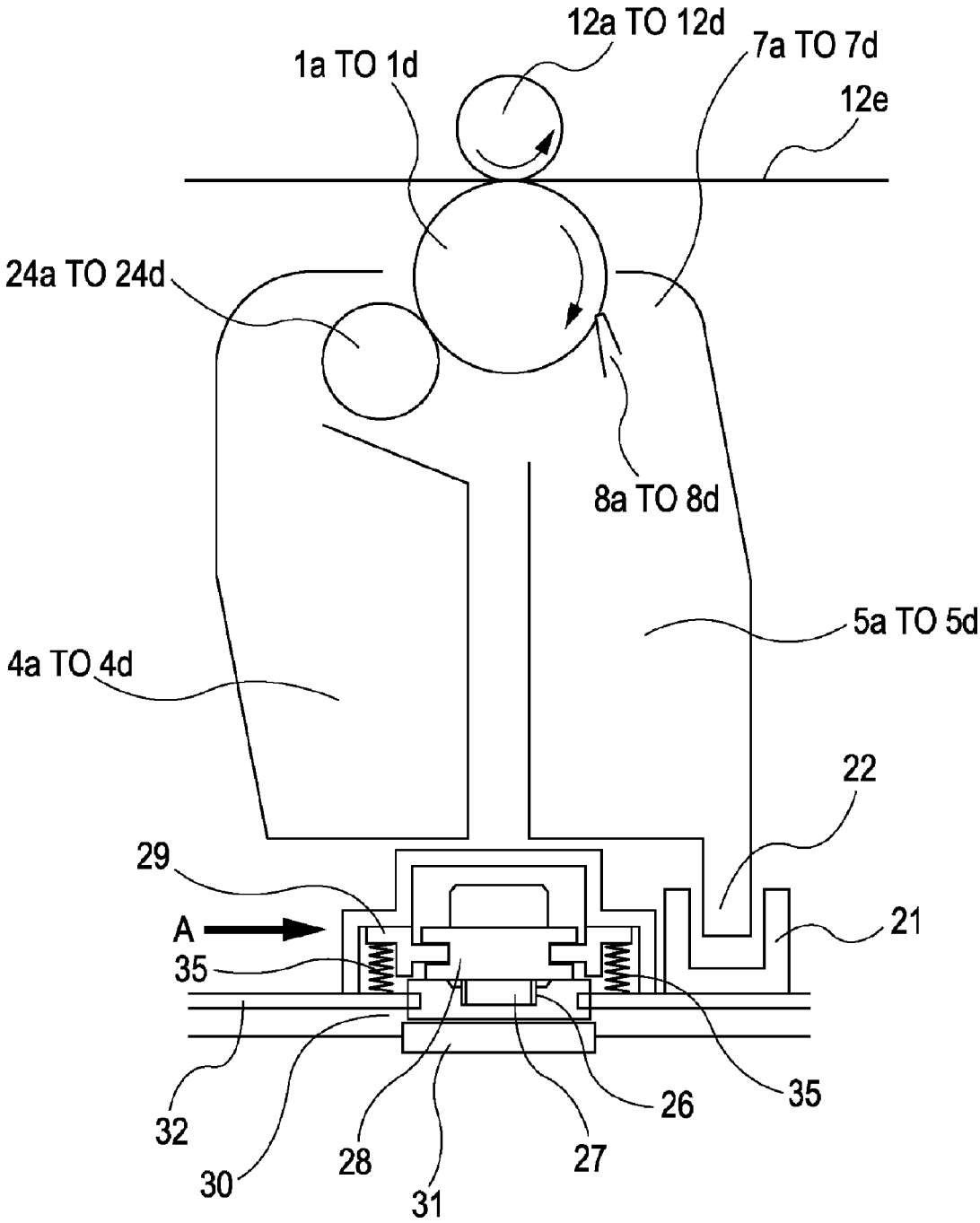
FIG. 2 is a configuration view of an optical device, a process cartridge, and a cleaning member according to the first embodiment.
Figure 3A:
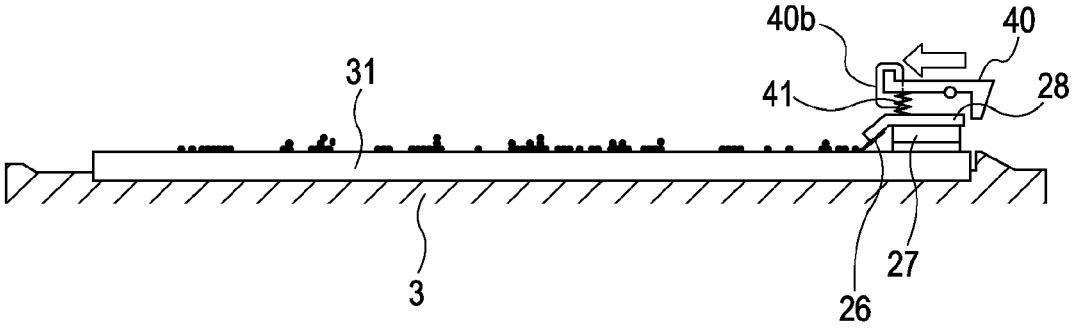
FIGS. 3A and 3B are configuration views of a cleaning member according to the first embodiment.
Figure 3B:
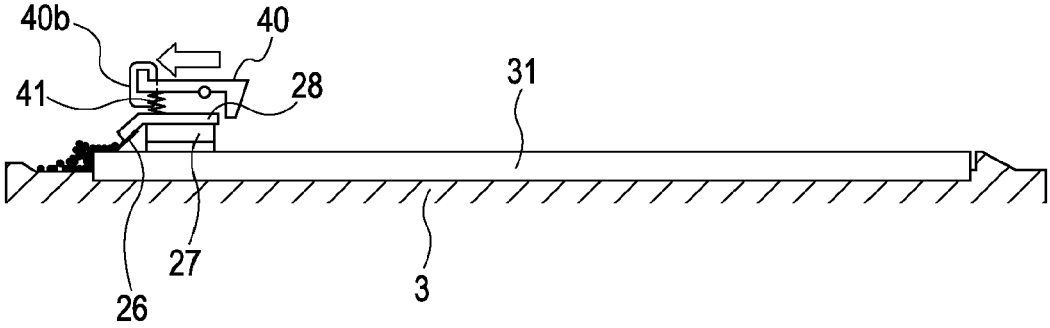
Figure 4A:
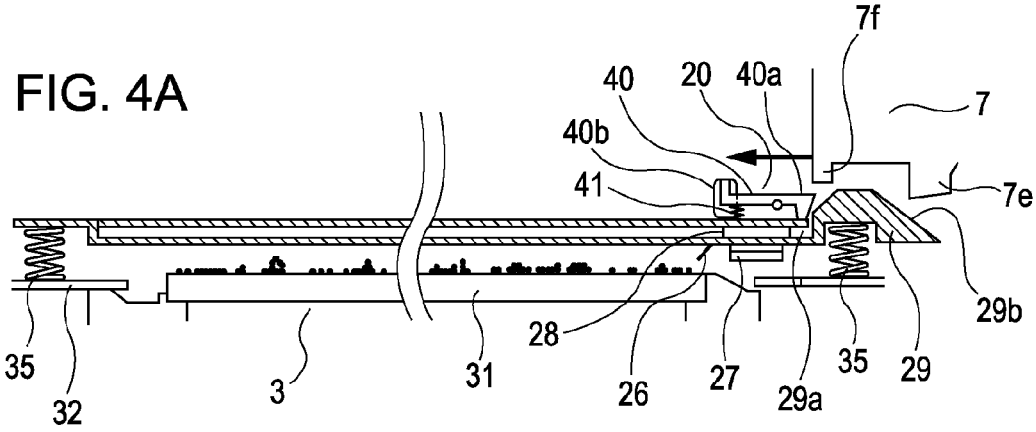
FIGS. 4A, 4B, and 4C are sectional views showing the process of cleaning of the cleaning member according to the first embodiment.
Figure 4B:
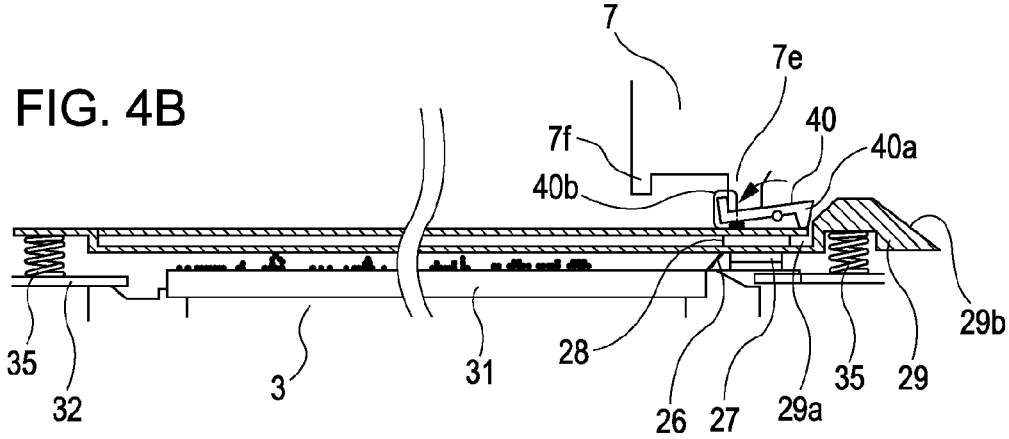
Figure 4C:
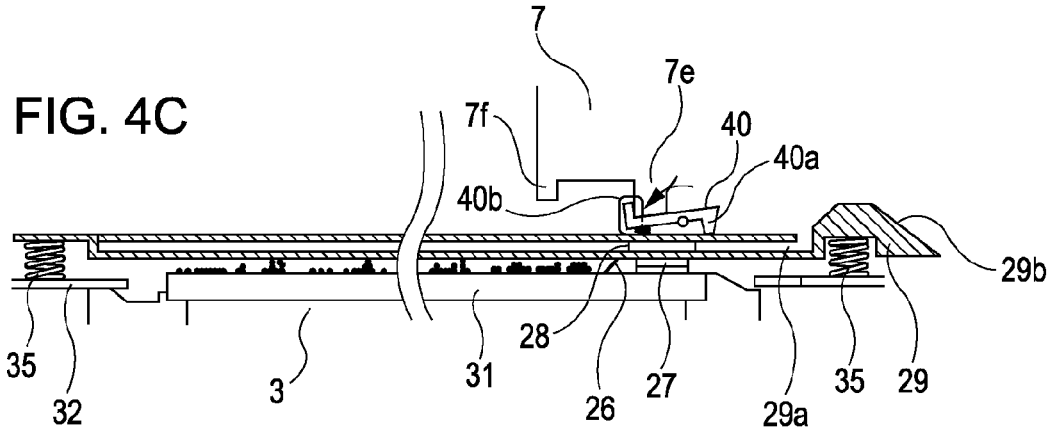

FIG. 2 is a configuration view of a process cartridge 7, an optical device 3, and a cleaning member 20. FIGS. 3A and 3B are configuration views of a cleaning member 20. FIGS. 4A, 4B, and 4C show the process of cleaning.

As shown in FIG. 2, the main body of the image forming apparatus has a stay member 32 that forms the framework of the main body. The stay member 32 has an opening 30 for forming a light path of the optical device 3, and a cartridge insertion guide 21 disposed near the opening 30. An insertion rib 22 is formed integrally with the process cartridge 7. By attaching the process cartridge 7 with the insertion rib 22 along the insertion guide 21, the process cartridge 7 can be easily placed at a predetermined position in the main body in the direction of the axis of rotation of the photosensitive drum 1. When the process cartridge 7 is positioned in the main body, a boss (not shown) disposed on the process cartridge 7 is fitted into a hole (not shown) of the main body. In this state, the insertion rib 22 is out of contact with the insertion guide 21.

A cover glass 31 serving as a transmitting member is disposed so as to cover the opening 30. Thereby, foreign substances such as dust and toner passing through the opening 30 are prevented from entering the optical device 3, and functional components in the optical device 3 are prevented from being contaminated and leading to a defective image. The cover glass 3 transmits light that is emitted from the optical device 3 to expose the photosensitive drum 1. The cover glass 31 is elongate. To transmit light emitted toward the photosensitive drum 1, the cover glass 31 is disposed such that the direction of the axis of rotation of the photosensitive drum 1 substantially corresponds to the longitudinal direction of the elongate cover glass 31.

As shown in FIGS. 3A, 3B, 4A, 4B, and 4C, the printer 100 has a cleaning member 20 that rubs the surface (cleaning surface) of the cover glass 31, thereby cleaning the cover glass 31. The cleaning member 20 includes a cleaning sheet 26, a wiping member 27, a base member 28, a lock member 40, a lock urging spring 41 serving as an urging member. The cleaning member 20 is supported by a base guide (guide member) 29 that faces the cover glass 31. The cleaning member 20 is slidably attached to the base guide 29 in the longitudinal direction of the cover glass 31. The cleaning member 20 is slidable in the longitudinal direction of the cover glass 31 in conjunction with the attachment of the process cartridge 7 into the main body.

The cleaning sheet 26 and the wiping member 27 are attached to the lower surface of the base member 28. The lock member 40 is rotatably attached to the upper surface of the base member 28. The lock urging spring 41 is provided between the lock member 40 and the base member 28. The lock urging spring 41 is provided at the front end of the base member 28 in the direction of attachment of the process cartridge 7. The lock urging spring 41 urges the lock member 40 in a lock direction (a direction in which a holding pawl 40*a* engages with an engaging hole 29*a*) around a rotating shaft provided in the middle of the base member 28 in the direction of attachment of the process cartridge 7.

The lock member 40 has a downward projecting holding pawl 40*a* at the rear end of the base member 28 in the direction of attachment of the process cartridge 7 and an upward projecting engaging pawl 40*b* at the front end of the base member 28 in the direction of attachment of the process cartridge 7. At one end of the base guide 29 is provided an engaging hole 29*a* with which the holding pawl 40*a* engages.

When the process cartridge 7 is not loaded in the main body, the lock member 40, subjected to the urging force of the lock urging spring 41, engages with the engaging hole 29*a* of the base guide 29, thereby holding the cleaning member 20 at the cleaning start position and preventing the cleaning member 20 from moving in the longitudinal direction of the cover glass 31 relative to the base guide 29. When the process cartridge 7 is attached to the main body, the process cartridge 7 engages with the lock member 40 and disengages the holding pawl 40*a* from the engaging hole 29*a* against the urging force of the lock urging spring 41. Thereby, the lock member 40 unlocks the cleaning member 20 and enables the cleaning member 20 to move from the cleaning start position.

The process cartridge 7 has a cleaning member engaging portion 7*e* projecting downward (on the cleaning member 20 side) and a second engaging portion 7*f*. The cleaning member engaging portion 7*e* is disposed downstream of the second engaging portion 7*f* in the direction of attachment of the process cartridge 7 and projects further downward (on the cleaning member 20 side) than the second engaging portion 7*f*.

When the process cartridge 7 is attached, the cleaning member engaging portion 7*e* slides on a slope 29*b* and urges the base guide 29 downward, and the second engaging portion 7*f* goes over the engaging pawl 40*b* without engaging with the engaging pawl 40*b*. Therefore, when the process cartridge 7 is attached, the cleaning member engaging portion 7*e* engages with the engaging pawl 40*b*. When the process cartridge 7 is removed, the second engaging portion 7*f* engages with the engaging pawl 40*b*.

The cleaning sheet 26 has flexibility. At the time of cleaning, the front edge of the cleaning sheet 26 comes into contact with the surface of the cover glass 31, and the cleaning sheet 26 moves the foreign substances.

The wiping member 27 is disposed such that part of the wiping member 27 is in contact with the cover glass 31 at the time of cleaning, and wipes foreign substances that remain on the surface of the cover glass 31 after the cleaning sheet 26 moves the foreign substances.

As shown in FIGS. 3A and 3B, the contact angle formed between the cleaning sheet 26 and the cover glass 31 when the cleaning sheet 26 is in contact with the cover glass 31 (the angle on the downstream side in the direction in which the cleaning member 20 moves at the time of cleaning) is an obtuse angle, and it is set to 135° in this embodiment. Thereby, even large amounts of toner and dust can be moved, and the amount of toner and dust that slip through the cleaning sheet 26 can be reduced. If the contact angle formed between the cleaning sheet 26 and the cover glass 31 is too large, instead of the front edge, the underside of the cleaning sheet 26 comes into contact with the cover glass 31, and large amounts of toner and dust slip through the cleaning sheet 26. If the contact angle formed between the cleaning sheet 26 and the cover glass 31 is too small, the cleaning sheet 26 is everted. A contact angle set to 135° may prevent the defective cleaning of the cleaning sheet 26 and the eversion of the cleaning sheet 26 as described when the angle formed between the cleaning sheet and the cover glass is too large or too small.

The front edge of the cleaning sheet 26 is in contact with the cover glass 31 in a bent state. The wiping member 27 is in contact with the cover glass 31 in an urged and compressed state. In this embodiment, a polyester sheet 100 μm thick is used as the cleaning sheet 26, and a urethane foam sheet 2 mm thick with a hardness of about 100 N to which a polyester nonwoven fabric 1.5 mm thick is welded is used as the wiping member 27. The cleaning sheet 26 is bent by 1 mm, and the wiping member 27 is compressed by 1 mm when in use.

At the time of cleaning, the cleaning member 20 is moved in the direction of arrow in FIGS. 3A and 3B, the front edge of the cleaning sheet 26 thereby moves foreign substances such as toner and dust on the cover glass 31, and the wiping member 27 wipes off foreign substances that are not moved by the cleaning sheet 26. The cover glass 31 is elongate in the direction of the axis of rotation of the photosensitive drum 1, and the cleaning member 20 moves in the longitudinal direction of the cover glass 31. The longitudinal direction of the cover glass 31 substantially corresponds to the direction of the axis of rotation of the photosensitive drum 1 so that light can reliably pass through the cover glass 31 and fall on the photosensitive drum 1. In this configuration, compared to the configuration in which the cleaning member 20 moves in the width direction of the cover glass 31, the area of contact between the cleaning member 20 and the surface of the cover glass 31 is small. Therefore, it is easy to maintain uniform contact between the cleaning member 20 and the surface of the cover glass 31, and contact failure between the cleaning member 20 and the cover glass 31 can be prevented.

Operation of Cleaning Member

The process of cleaning will now be described. FIGS. 4A, 4B, 4C, 5A, and 5B are sectional views showing the process of cleaning of the cleaning member 20.

In FIG. 4A, the cleaning member 20 is slidably attached to the base guide 29 and is located at a home position (cleaning start position) before cleaning at one end of the base guide 29.

At the home position, the lock member 40 is pressed by the lock urging spring 41 clockwise. In this state, the holding pawl 40*a* of the lock member 40 engages with the engaging hole 29*a* of the base guide 29 and holds the base member 28 of the cleaning member 20 at a given position on the base guide 29. The lock member 40 prevents the cleaning member 20 from moving from the cleaning start position.

Between the cover glass 31 and the base guide 29 are provided base guide urging members 35. The base guide urging members 35 lift the base guide 29 to a height at which the cleaning sheet 26 and the wiping member 27 are out of contact with the cover glass 31.

When the process cartridge 7 is attached to the main body of the image forming apparatus, the engaging portion 7*e* of the process cartridge 7 comes into contact with the slope 29*b* at the front end of the base guide 29 (near the attachment opening). Thereby, the base guide 29 is pressed down against the urging force of the base guide urging members 35.

Further attachment of the process cartridge 7 into the main body of the image forming apparatus causes the engaging portion 7*e* to go along the slope 29*b* and reach the top surface of the lock member 40 as shown in FIG. 4B. The engaging portion 7*e* rotates the lock member 40 counterclockwise against the urging force of the lock urging spring 41 and engages with the engaging pawl 40*b* of the lock member 40 while disengaging the holding pawl 40*a* from the engaging hole 29*a* of the base guide 29.

Against the urging force of the base guide urging members 35, the engaging portion 7*e* presses down the base member 28 together with the lock member 40. The front edge of the cleaning sheet 26 contacts the surface of the cover glass 31 by 1 mm and is ready for cleaning.

As shown in FIG. 4C, further attachment of the process cartridge 7 moves the base member 28 in the longitudinal direction of the cover glass 31, and the cleaning sheet 26 and the wiping member 27 move to the cleaning end position while cleaning the cover glass 31.

Next, a description will be given of the process of returning the cleaning member 20 to the home position (cleaning start position) by detaching the process cartridge 7.

Figure 5A:
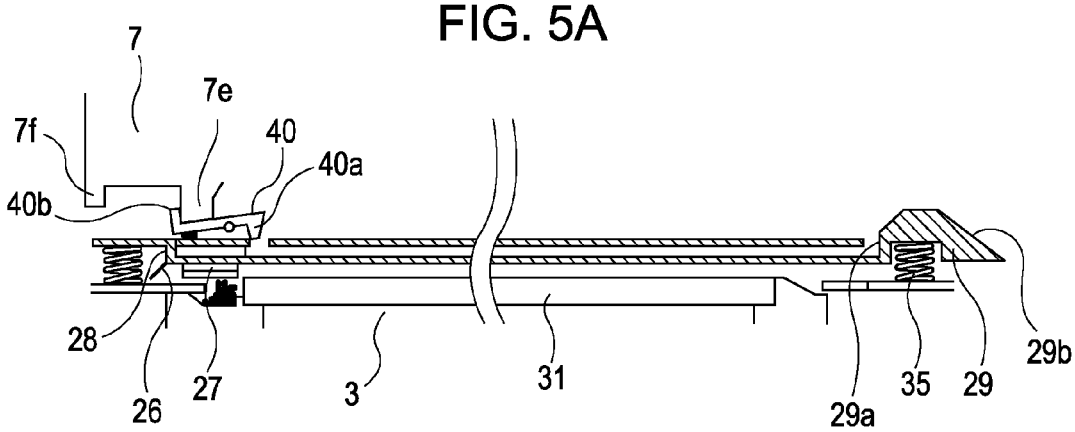
FIGS. 5A and 5B are sectional views showing the process of cleaning of the cleaning member according to the first embodiment.

As shown in FIG. 5A, the process cartridge 7 starts to be returned in the detachment direction (the opposite direction from the attachment direction (the insertion direction)). Thereby, the engaging portion 7*e* moves on the top surface of the lock member 40 in the detachment direction (the pull-out direction) and separates from the lock member 40, and the cleaning sheet 26 and the wiping member 27 separate from the cover glass 31 by the urging force of the base guide urging members 35.

Figure 5B:
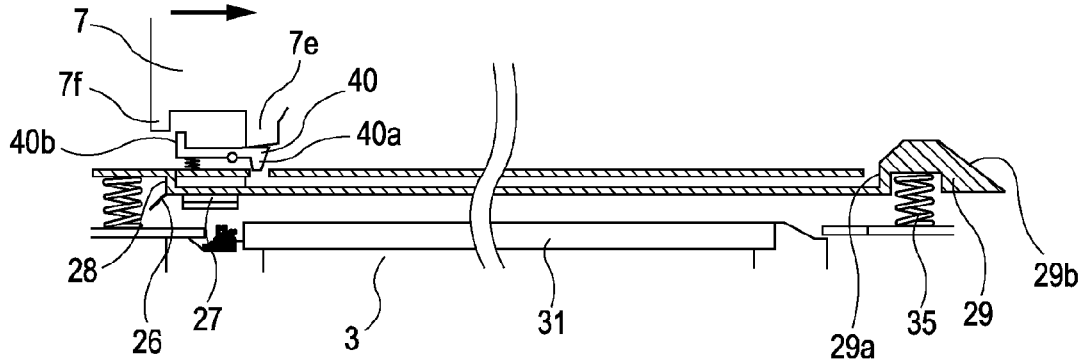

As shown in FIG. 5B, further movement of the process cartridge 7 in the detachment direction engages the second engaging portion 7*f* of the process cartridge 7 with the engaging pawl 40*b* of the lock member 40. The process cartridge 7 moves in the detachment direction, and the base member 28 of the cleaning member 20 is returned to the home position together with the lock member 40.

The holding pawl 40*a* of the lock member 40 returned to the home position engages with the engaging hole 29*a* of the base guide 29, and the lock member 40 is held at a given position in the base guide 29.

As described above, according to this embodiment, the cleaning member 20 cleans the cover glass 31 in conjunction with the attachment of the process cartridge 7. Therefore, the cover glass 31 can be fully cleaned without requiring a user or serviceman to carefully clean the cover glass 31. According to this embodiment, the cleaning member 20 is held at a fixed position (home position) before the attachment of the process cartridge 7, i.e., before the start of cleaning. Therefore, the cleaning member 20 is prevented from being accidentally displaced from the home position by the product transportation or a user operation when the process cartridge 7 is not loaded in the main body. If the cleaning member 20 is displaced from the home position to a halfway position before the start of cleaning, cleaning is started from the halfway position when the process cartridge 7 is attached, and the cover glass 31 cannot be fully cleaned by a single attachment of the process cartridge 7. However, according to this embodiment, the cleaning member 20 can be made to operate in the longitudinal direction of the cover glass 31 from the cleaning start position to the cleaning end position by a single attachment of the process cartridge 7. Therefore, the cleaning member 20 can operate stably, and accidents such as breakage can be prevented.

In this embodiment, when cleaning is performed, the engaging portion 7*e* and the second engaging portion 7*f* of the process cartridge 7 directly engages with the cleaning member 20. However, the process cartridge 7 may engage with the cleaning member 20 with a member of the main body therebetween as long as the cleaning member 20 moves in conjunction with the attachment and detachment of the process cartridge 7. For example, a drawer-like unit on which the process cartridge 7 is mounted and that can be attached to and detached from the main body, may engage with the cleaning member 20.

In this embodiment, a process cartridge 7 is taken as an example of a unit that can be attached to and detached from the main body. However, the present invention is not limited to this. Any unit that a user attaches and detaches in a normal use environment is suitable. For example, the above-described drawer-like unit or a sheet cassette that is attached to and detached from the main body for setting sheets is suitable. What is important is that the cleaning member 20 can be moved in conjunction with the attachment and detachment of a unit by a user required in a normal use environment. Thereby, the cover glass 31 can be cleaned without requiring a special operation for cleaning.

An apparatus according to a second embodiment will now be described with reference to FIGS. 6A, 6B, 6C, 7A, 7B, 8A, 8B, and 8C. The basic configuration of the apparatus of this embodiment is the same as that of the first embodiment. The redundant description will be omitted, and the characteristic configuration of this embodiment will be described. The same reference numerals will be used to designate functionally the same components as those in the first embodiment.

In the second embodiment, at one end of the cover glass 31 in the longitudinal direction (upstream of the cover glass 31 in the direction in which the cleaning sheet 26 moves at the time of cleaning) is disposed a projecting portion 70 against which one end of the cover glass 31 is abutted. At the other end of the cover glass 31 in the longitudinal direction (downstream of the cover glass 31 in the direction in which the cleaning sheet 26 moves at the time of cleaning) is disposed an accumulating portion 33 for accumulating foreign substances that the cleaning sheet 26 clears off of the surface of the cover glass 31.

The accumulating portion 33 is a depressed portion disposed outside the light path area. The accumulating portion 33 is disposed above the lower end of the optical device 3 (in the upper surface of the optical device 3) and below the surface (cleaning surface) of the cover glass 31. Foreign substances can be accumulated in one place without being scattered in the apparatus. In addition, foreign substances accumulated in the accumulating portion 33 can be prevented from going back into the light path area due to a vibration generated from the main body of the image forming apparatus or an external shock.

Operation of Cleaning Member

The process of cleaning by the cleaning member will now be described. FIGS. 6A, 6B, 6C, 7A, and 7B are sectional views showing the process of cleaning by the cleaning member 20.

Figure 6A:
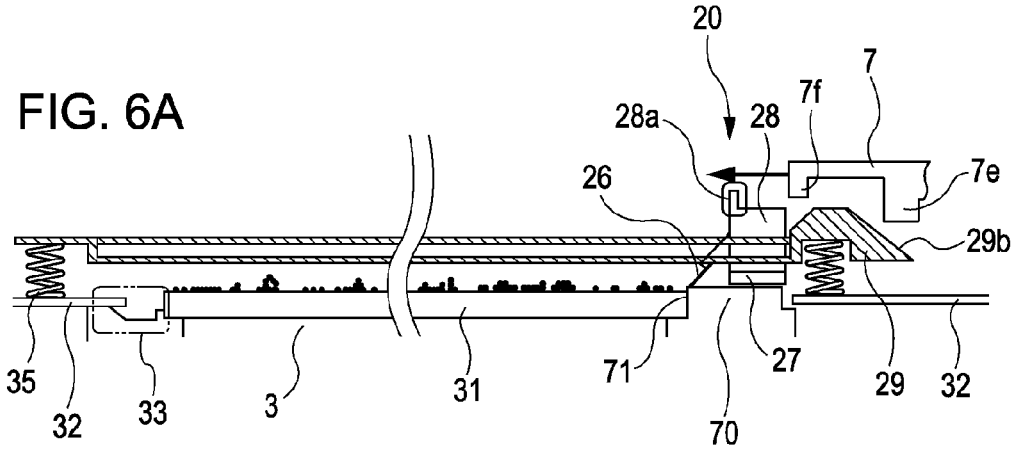
FIGS. 6A, 6B, and 6C are sectional views showing the process of cleaning of a cleaning member according to a second embodiment.

In FIG. 6A, the cleaning member 20 is located at the home position (cleaning start position) before cleaning. One end of the cover glass 31 on the right side in FIG. 6A (on the cleaning start position side) is abutted against the projecting portion 70 provided on the case of the optical device 3. The top surface of the projecting portion 70 is higher than the surface (cleaning surface) of the cover glass 31. A step 71 is provided between the top surface of the projecting portion 70 and the surface of the cover glass 31. When the cleaning member 20 moves from the cleaning start position to the cleaning end position, the cleaning sheet 26 and the wiping member 27 of the cleaning member 20 come into contact with the top surface of the projecting portion 70 before coming into contact with the surface of the cover glass 31.

Figure 6B:
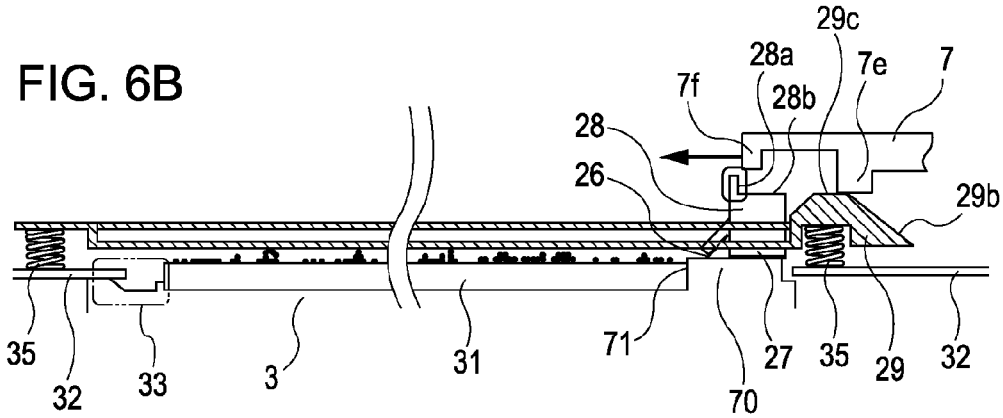
Figure 6C:
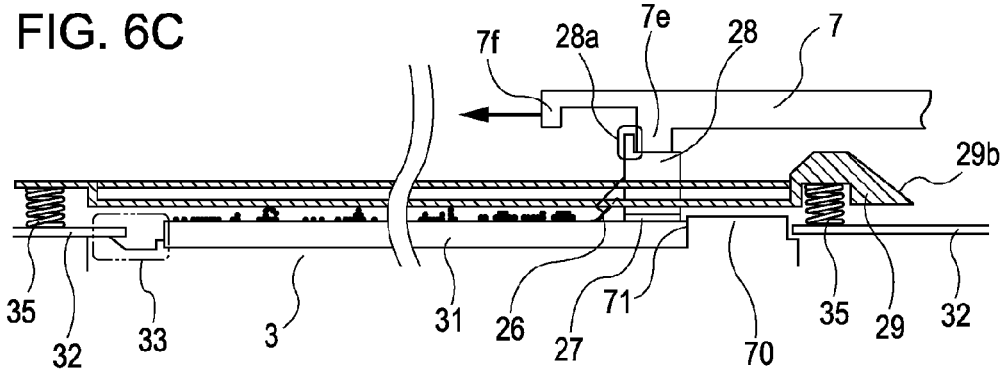

To move the cleaning member 20 from the home position to clean the surface of the cover glass 31, the process cartridge 7 is moved along the insertion guide 21 to the left in FIGS. 6A, 6B, and 6C (in the direction of the axis of rotation of the photosensitive drum 1 and in the longitudinal direction of the cover glass 31). Thereby, the engaging portion 7*e* provided on the process cartridge 7 comes into contact with the slope 29*b* at the front end of the base guide 29. Thereby, the base guide 29 is pressed down against the urging force of the base guide urging members 35.

The engaging portion 7*e* of the process cartridge 7 moves along the slope 29*b* with the attachment of the process cartridge 7, reaches the top surface 29*c* of the base guide 29, moves from the base guide 29 to a slide surface 28*b* of the base member 28 of the cleaning member 20, and presses down the base member 28. As shown in FIG. 6B, the front edge of the cleaning sheet 26 and the wiping member 27 comes into contact with the top surface of the projecting portion 70 provided on the optical device 3.

The engaging portion 7*e* of the process cartridge 7 engages with an engaging portion 28*a* of the base member 28 while pressing down the base member 28. When the base member 28, pressed by the process cartridge 7, moves in the longitudinal direction of the cover glass 31 with the attachment of the process cartridge 7, the cleaning sheet 26 and the wiping member 27 move on the top surface of the projecting portion 70. The cleaning sheet 26 and the wiping member 27 fall from the top surface of the projecting portion 70, across the end portion of the cover glass 31, onto the surface of the cover glass 31. Thus, when the cleaning member 20 starts a cleaning operation, the front edge of the cleaning sheet 26 can come into contact with the surface of the cover glass 31 without catching on the end portion of the cover glass 31. Thereby, the cleaning sheet 26 can be prevented from being damaged by catching on the end portion of the cover glass 31, and the cleaning performance of the cleaning sheet 26 can be prevented from deteriorating.

Thereafter, as shown in FIG. 6C, as the process cartridge 7 moves the base member 28 in the cleaning direction, the cleaning sheet 26 and the wiping member 27 move in the same direction (in the longitudinal direction of the cover glass 31) while cleaning the surface of the cover glass 31. As described above, in conjunction with the attachment of the process cartridge 7, the cleaning member 20 moves on the surface of the cover glass 31 and cleans the surface of the cover glass 31.

Figure 7A:
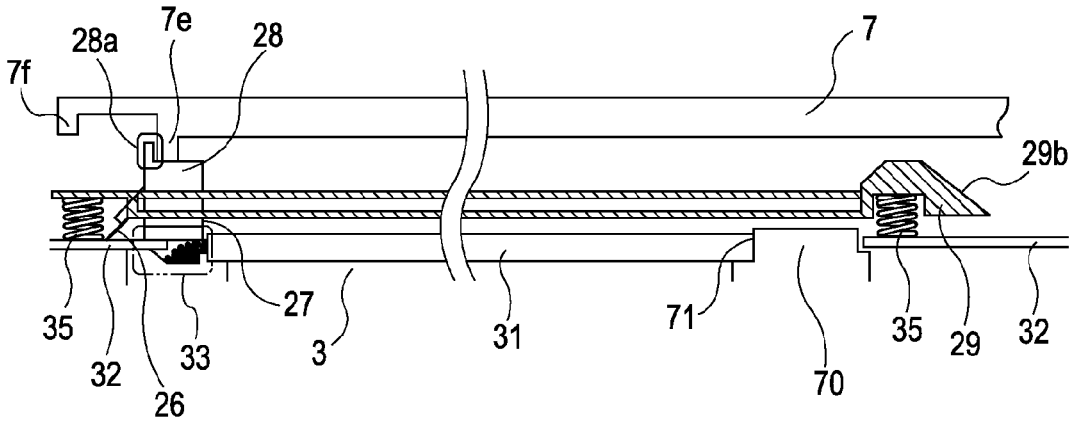
FIGS. 7A and 7B are sectional views showing the process of cleaning of the cleaning member according to the second embodiment.

As shown in FIG. 7A, after the cleaning sheet 26 and the wiping member 27 finish cleaning up to the other end of the cover glass 31 on the left in FIG. 7A (on the cleaning end position side), foreign substances moved by the cleaning sheet 26 are dropped into the accumulating portion 33. Extremely small amounts of foreign substances wiped off by the wiping member 27 remain trapped on the wiping member 27.

Figure 7B:
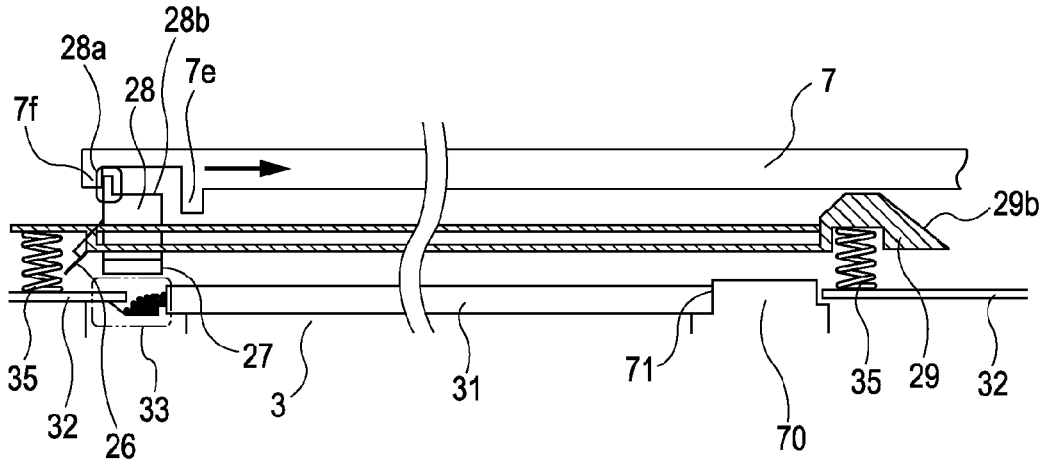

When the process cartridge 7 is detached from the main body, as shown in FIG. 7B, the process cartridge 7 is returned in the detachment direction (the opposite direction from the attachment direction). The engaging portion 7*e* of the process cartridge 7 moves on the slide surface 28*b* of the base member 28 in the detachment direction and leaves the slide surface 28*b*. The cleaning sheet 26 and the wiping member 27 that are in contact with the surface of the cover glass 31 and bent and compressed, respectively, by the engaging portion 7*e* by a predetermined amount (1 mm in this embodiment) are lifted off the surface of the cover glass 31 by the urging force of the urging members 35.

The process cartridge 7 is further moved in the detachment direction, and thereby the second engaging portion 7*f* provided at the front end of the process cartridge 7 engages with the engaging portion 28*a* of the base member 28. In conjunction with the movement of the process cartridge 7 in the detachment direction, the cleaning sheet 26 and the wiping member 27 move at a distance from the surface of the cover glass 31 and in the longitudinal direction of the cover glass 31, and the base member 28 is returned to the home position. Since the cleaning sheet 26 and the wiping member 27 move at a sufficient distance from the surface of the cover glass 31, the cleaning sheet 26 and the wiping member 27 do not catch on the step 71 of the projecting portion 70.

As described above, as in the first embodiment, the cleaning member 20 cleans the cover glass 31 in conjunction with the attachment of the process cartridge 7. Therefore, the cover glass 31 can be fully cleaned without requiring a user or serviceman to perform an operation for cleaning.

According to this embodiment, when the process cartridge 7 is attached to the main body, the cleaning sheet 26 and the wiping member 27 move on the top surface of the projecting portion 70 provided on the optical device 3. The cleaning sheet 26 and the wiping member 27 then fall from the top surface of the projecting portion 70, across the end portion of the cover glass 31, onto the surface of the cover glass 31. Thus, when the cleaning member 20 starts a cleaning operation, the front edge of the cleaning sheet 26 can come into contact with the surface of the cover glass 31 without catching on the end portion of the cover glass 31. Thereby, the cleaning sheet 26 can be prevented from being damaged by catching on the end portion of the cover glass 31, and the cleaning performance of the cleaning sheet 26 can be prevented from deteriorating. The cleaning sheet 26 and the wiping member 27 can smoothly land on the surface of the cover glass 31 without catching on the end portion of the cover glass 31. This gives the operator a smooth feeling when the operator attaches the process cartridge 7 and thereby moves the cleaning sheet 26 and the wiping member 27.

Figure 8A:
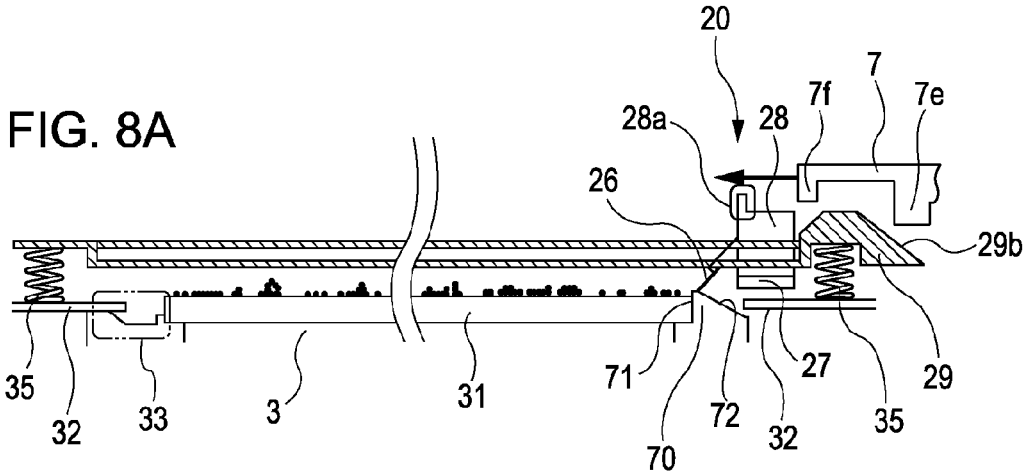
FIGS. 8A, 8B, and 8C are sectional views showing the process of cleaning of the cleaning member according to the second embodiment.
Figure 8B:
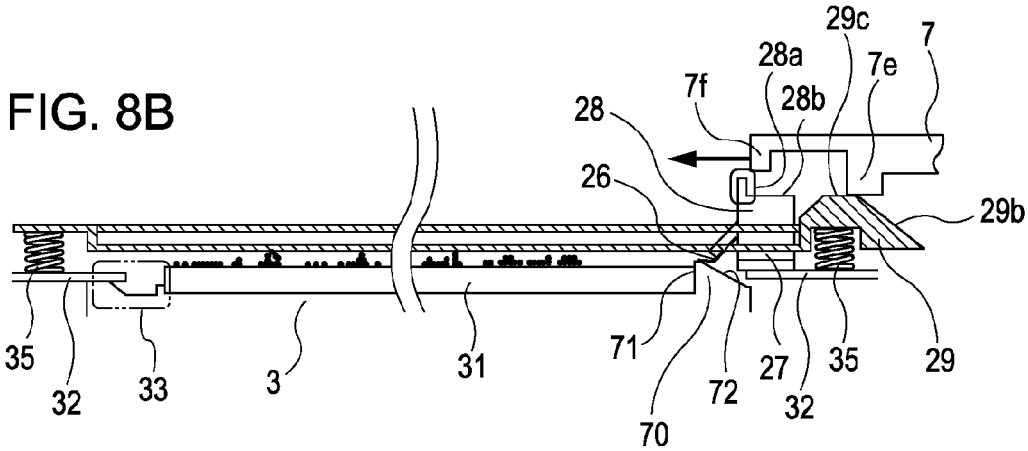
Figure 8C:
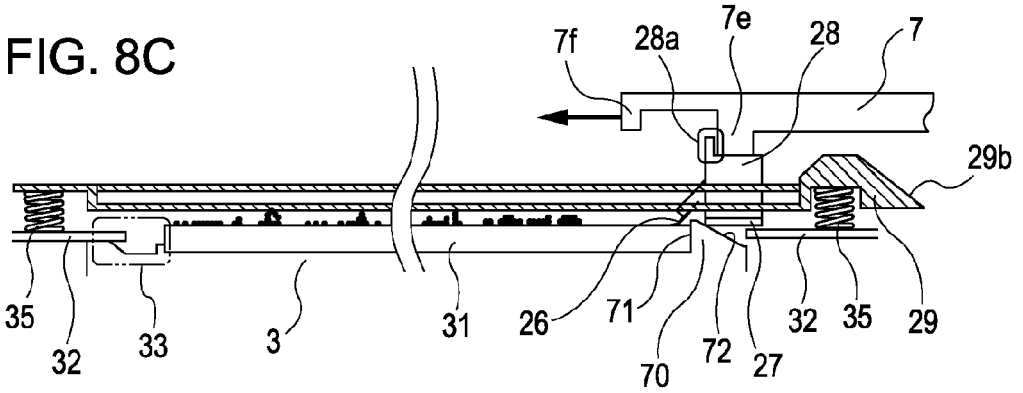

As shown in FIGS. 8A, 8B, and 8C, the projecting portion 70 is provided with a slope 72 in a part with which the cleaning sheet 26 and the wiping member 27 come into contact, the slope 72 sloping in the direction in which the cleaning member 20 moves from the cleaning start position to the cleaning end position. In this embodiment, the slope 72 slopes upward to the top surface of the projecting portion 70.

In the case where the projecting portion 70 has the slope 72 on the cleaning start position side thereof as shown in FIGS. 8A, 8B, and 8C, when cleaning is started, the front edge of the cleaning sheet 26 and the wiping member 27 first come into contact with the slope 72 of the projecting portion 70 provided on the optical device 3 as shown in FIG. 8B. As the process cartridge 7 moves the base member 28 in the cleaning direction (with the attachment of the process cartridge 7), the cleaning sheet 26 and the wiping member 27 move on the slope 72 of the projecting portion 70 and then fall from the projecting portion 70 onto the surface of the cover glass 31. As described above, by providing the slope 72 on the cleaning start position side (the upstream side in the direction in which the cleaning sheet 26 moves at the time of cleaning) of the projecting portion 70, the cleaning sheet 26 and the wiping member 27 can come into contact with the surface of the cover glass 31 more smoothly. The operability of the process cartridge 7 that moves the base member 28 of the cleaning member 20 at the start of cleaning is further improved, and an image forming apparatus having a high degree of usability can be provided.

The cover glass 31 can be extended to the home position of the cleaning sheet 26 and the wiping member 27. However, the increase in the size of the cover glass increases the cost and size of the apparatus. The above-described configuration can improve the durability and cleaning performance of the cleaning member and the feeling at the time of the cartridge operation without increasing the size of the cover glass 31.

An apparatus according to a third embodiment will now be described with reference to FIGS. 9A, 9B, and 10. The basic configuration of the apparatus of this embodiment is the same as that of the first embodiment. The redundant description will be omitted, and the characteristic configuration of this embodiment will be described. The same reference numerals will be used to designate functionally the same components as those in the first embodiment.

Figure 9A:
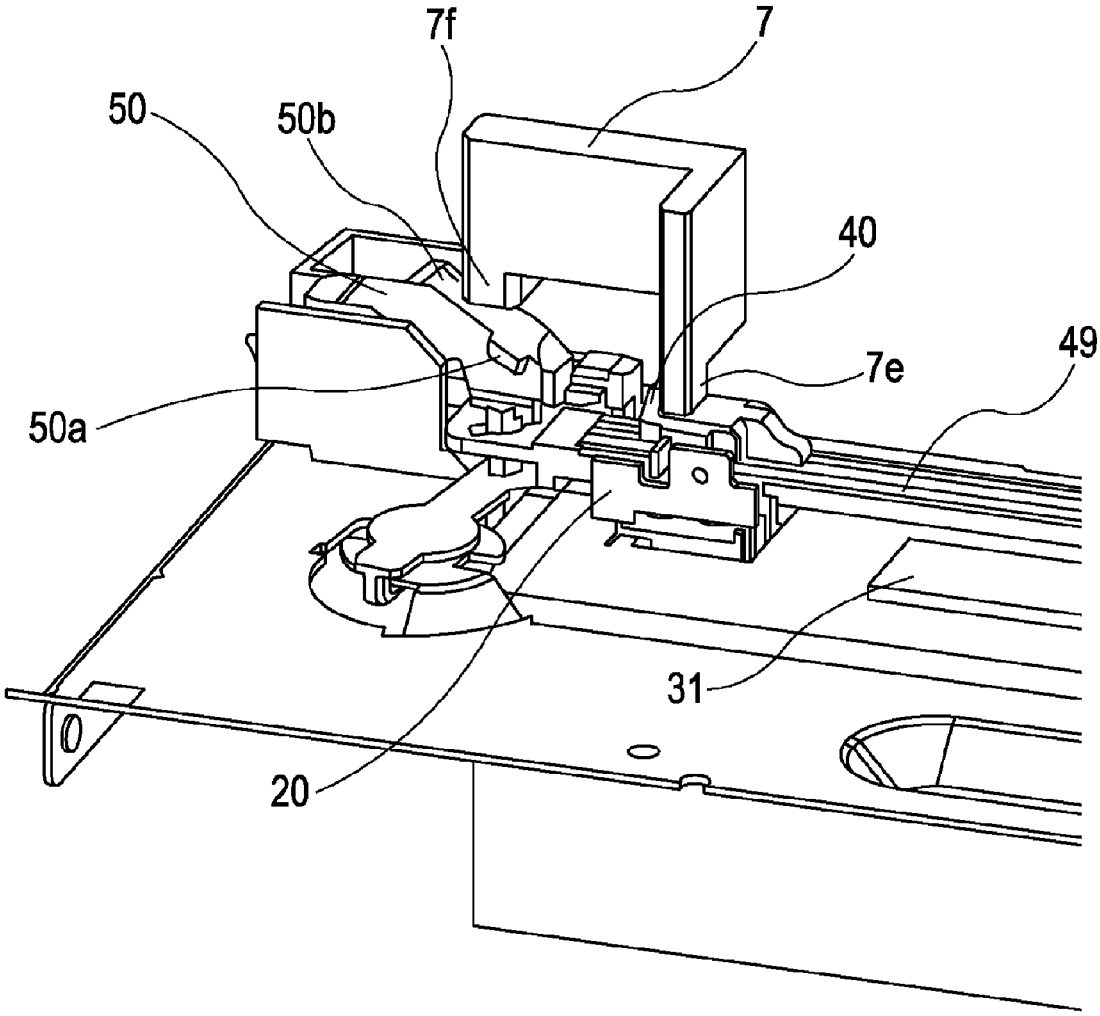
FIGS. 9A and 9B show the release of the engagement between a cleaning member and a process cartridge according to a third embodiment.
Figure 9B:
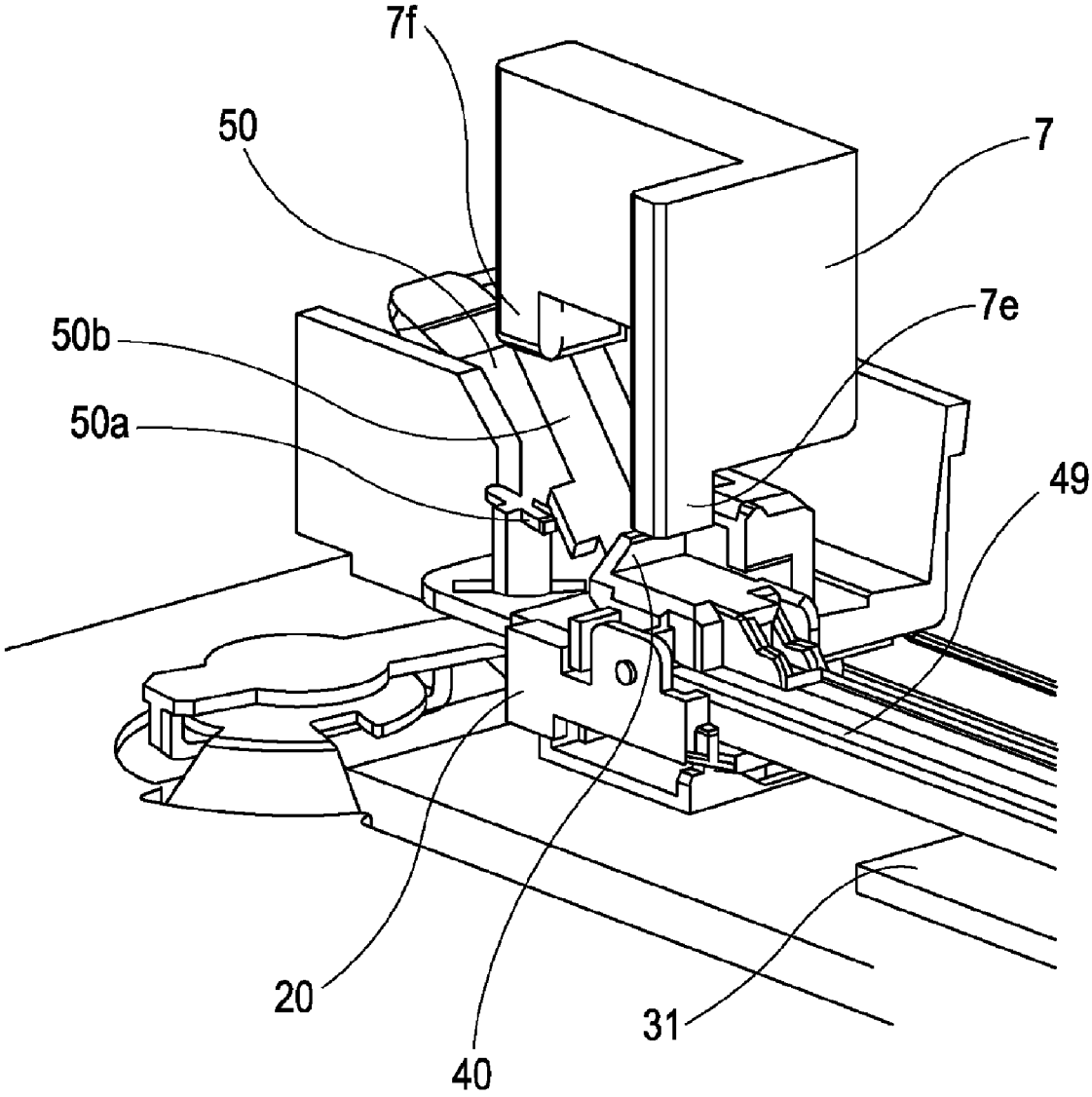
Figure 10:
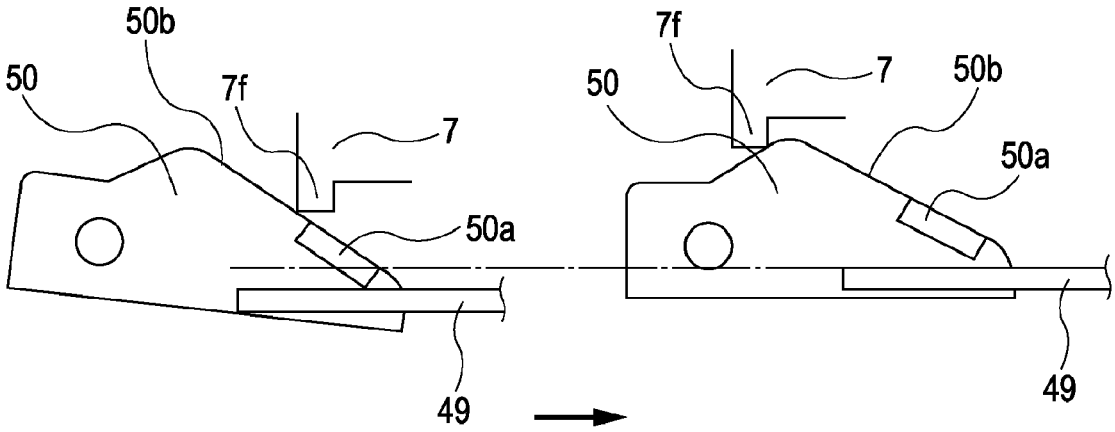
FIG. 10 shows the release of the engagement between the cleaning member and the process cartridge according to the third embodiment.

As shown in FIGS. 9A, 9B, and 10, in the third embodiment, a latch member 50 that urges the process cartridge 7 toward the image forming position is provided near the rear end of the base guide 49 in the longitudinal direction (the downstream end of the base guide 49 in the direction in which the cleaning sheet 26 moves at the time of cleaning, i.e., the rear end of the base guide 49 in the direction in which the process cartridge 7 is attached). The latch member 50 has a pawl portion 50*a* and a tapered portion 50*b*. The latch member 50 is provided rotatably around an axis near the end opposite the end at which the pawl portion 50*a* is provided.

The pawl portion 50*a* can press down the base guide 49. A second engaging portion 7*f* is formed on the lower surface of the process cartridge 7 and at the front end of the process cartridge 7 in the cartridge attachment direction.

In conjunction with the attachment of the process cartridge 7 into the main body, the cleaning member 20 moves from the cleaning start position to the cleaning end position in the longitudinal direction of the cover glass 31. With the attachment of the process cartridge 7, the engaging portion 7*e* engages with the lock member 40 of the cleaning member 20, and thereby the cleaning member 20 moves to the cleaning end position in the longitudinal direction of the cover glass 31.

As shown in FIG. 9A, at the cleaning end position after the cleaning member 20 cleans the cover glass 31, the process cartridge 7 further attached toward the back of the apparatus abuts against the tapered portion 50*b* of the latch member 50. The process cartridge 7 gets over the tapered portion 50*b* while pressing down the latch member 50.

When the latch member 50 is pressed down as shown in FIG. 9B, the pawl portion 50*a* presses down the base guide 49. Thereby, the cleaning member 20 attached to the base guide 49 moves away from the process cartridge 7 (downward). The downward movement of the cleaning member 20 disengages the lock member 40 of the cleaning member 20 from the process cartridge 7.

As shown in FIG. 10, after the pawl portion 50*a* of the latch member 50 presses down the base guide 49 and the lock member 40 of the cleaning member 20 is disengaged from the process cartridge 7, the process cartridge 7 is further attached, and the process cartridge 7 is urged by the latch member 50 and thereby moves upward. The base guide 49 pressed down by the pawl portion 50*a* of the latch member 50 returns to the original position, and the cleaning member 20 moves toward the process cartridge 7 (upward). However, since the process cartridge 7 has already moved upward, there is a sufficient distance between the process cartridge 7 and the lock member 40 of the cleaning member 20 when the process cartridge 7 reaches the image forming position.

After reaching the image forming position, the process cartridge 7 is urged by the latch member 50 toward the back of the apparatus and upward so as to be positioned at the image forming position.

As described above, according to this embodiment, as in the first and second embodiments, the cleaning member 20 cleans the cover glass 31 in conjunction with the attachment of the process cartridge 7. Therefore, the cover glass 31 can be fully cleaned without requiring a user or serviceman to perform an operation for cleaning.

According to this embodiment, when the process cartridge 7 is set at the image forming position, the process cartridge 7 can be easily disengaged from the cleaning member 20, and the operability when the process cartridge 7 is attached can be improved.

In this embodiment, a description is made of a configuration in which the engagement between the cleaning member 20 and the process cartridge 7 is released. However, a configuration is possible in which the engagement is not completely released, the amount of engagement is reduced, and the remaining engagement is released by the attachment locus of the process cartridge 7.

In this embodiment, a description is made of a configuration in which the latch member 50 moves the cleaning member 20 away from the process cartridge 7 (downward) and thereby the engagement between the cleaning member 20 and the process cartridge 7 is released. However, the present invention is not limited to this. What is important is that the cleaning member 20 is moved in a direction different from the longitudinal direction of the cover glass 31 so that the engagement between the cleaning member 20 and the process cartridge 7 is smoothly released during the loading of the process cartridge 7.

In this embodiment, a description is made of a configuration in which the latch member 50 is pressed down and thereby presses the base guide 49. However, the present invention is not limited to this. Alternatively, the latch member 50 may directly press the cleaning member 20. What is important is that the cleaning member 20 is moved by the movement of the latch member 50 accompanying the attachment of the process cartridge 7.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-090203 filed Mar. 31, 2008, No. 2008-090199 filed Mar. 31, 2008, and No. 2008-090202 filed Mar. 31, 2008, which are hereby incorporated by reference herein in their entirety.

What is claimed is:

1. An image forming apparatus comprising:

a unit that can be attached to and detached from a main body of the apparatus;

an optical device that irradiates a photosensitive member with light, the device including a transmitting member through which light passes;

a cleaning member that can move from a cleaning start position to a cleaning end position for cleaning the transmitting member, the cleaning member being capable of moving in conjunction with the attachment of the unit into the main body; and a lock member that prevents the cleaning member from moving, wherein when the unit is not loaded in the main body, the lock member prevents the cleaning member from moving from the cleaning start position, and when the unit is attached to the main body, the unit engages with the lock member and the cleaning member is unlocked and is able to move from the cleaning start position.

2. The image forming apparatus according to claim 1, further comprising:

a guide member that movably supports the cleaning member, wherein the cleaning member, supported by the guide member, moves relative to the guide member and cleans the transmitting member.

3. The image forming apparatus according to claim 2, further comprising:

an urging member that urges the lock member in a direction in which the lock member engages the guide member, wherein when the unit is attached to the main body, the unit engages the lock member and moves the lock member against the urging force of the urging member in a direction in which the lock member is disengaged from the guide member and enables the cleaning member to move from the cleaning start position.

4. The image forming apparatus according to claim 2, wherein the transmitting member is elongate, and the direction in which the cleaning member, supported by the guide member, moves relative to the guide member is a longitudinal direction of the transmitting member.

5. The image forming apparatus according to claim 4, wherein the photosensitive member is rotatable, and the unit can be attached to and detached from the main body in the direction of the axis of rotation of the photosensitive member, and the direction of the axis of rotation of the photosensitive member substantially corresponds to the longitudinal direction of the transmitting member.

6. The image forming apparatus according to claim 1, wherein the unit is a cartridge that has the photosensitive member and can be attached to and detached from the main body.

7. An image forming apparatus comprising:

a unit that can be attached to and detached from a main body of the apparatus;

an optical device that irradiates a photosensitive member with light, the device including a transmitting member through which light passes;

a cleaning member that can move from a cleaning start position to a cleaning end position for cleaning the transmitting member, the cleaning member being capable of moving in conjunction with the attachment of the unit into the main body; and a projecting portion that is disposed adjacent to the transmitting member with one end of the transmitting member abutting the projecting portion, the projecting portion having a top surface higher than the surface of the transmitting member.

8. An image forming apparatus comprising:

a cartridge that has a photosensitive member and can be attached to and detached from a main body of the apparatus;

an optical device that irradiates the photosensitive member with light, the device including an elongate transmitting member through which light passes;

a cleaning member that can move from a cleaning start position to a cleaning end position in a longitudinal direction of the transmitting member for cleaning the transmitting member, the cleaning member being capable of moving in conjunction with the attachment of the cartridge into the main body; and a latch member that urges the cartridge toward an image forming position, wherein the cartridge engages the cleaning member with the attachment of the cartridge into the main body, the cleaning member moves to the cleaning end position in the longitudinal direction of the transmitting member, the cartridge abuts against the latch member, and the latch member urges the cartridge toward the image forming position and moves the cleaning member in a direction different from the longitudinal direction of the transmitting member and releases the engagement between the cleaning member and the cartridge.

* * * * *